US007014186B2

(12) United States Patent
Shiohara et al.

(10) Patent No.: US 7,014,186 B2
(45) Date of Patent: Mar. 21, 2006

(54) SHEET FEEDER AND IMAGE FORMING APPARATUS HAVING THE SAME

(75) Inventors: Yukio Shiohara, Nagoya (JP); Koji Takito, Nisshin (JP); Hiroshi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 10/396,320

(22) Filed: Mar. 26, 2003

(65) Prior Publication Data

US 2003/0184001 A1 Oct. 2, 2003

(30) Foreign Application Priority Data

Mar. 29, 2002 (JP) ..... 2002-094506

(51) Int. Cl.
*B65H 3/52* (2006.01)

(52) U.S. Cl. ..... 271/121; 271/124; 271/127

(58) Field of Classification Search ..... 271/121, 271/127, 124
See application file for complete search history.

(56) References Cited

U.S. PATENT DOCUMENTS 5,145,164 A * 9/1992 Kan ..... 271/170
5,443,251 A * 8/1995 Kan et al. ..... 271/16
5,895,040 A 4/1999 Oleksa et al.
5,971,390 A * 10/1999 Caspar et al. ..... 271/121
6,158,733 A 12/2000 Muraki
6,716,254 B1 * 4/2004 Takeuchi ..... 271/167

FOREIGN PATENT DOCUMENTS

JP 08192933 A * 7/1996
JP 2000168980 A * 6/2000
JP A 2001-253580 9/2001
JP A 2001-278507 10/2001

* cited by examiner

*Primary Examiner*—Donald P. Walsh
*Assistant Examiner*—Kaitlin Joerger
(74) *Attorney, Agent, or Firm*—Oliff & Berridge, PLC

(57) ABSTRACT

An inclined separating surface includes an upwardly curved surface that is gradually lowered near the ends, from a middle portion in a sheet width direction as a top. The inclined separating surface holds leading edges of sheets stacked on a sheet holder. At the middle of the inclined separating surface, a sheet separating unit, which extends in a sheet advance direction, is provided so as to protrude from and retract into the inclined separating surface. With this structure, the leading edges of side areas of the sheets do no contact the inclined separating surface before the leading edges of middle areas of the sheets contact the inclined separating surface. Consequently, the leading edges of the middle areas of the sheets are surely applied with separating action by the sheet separating unit.

17 Claims, 10 Drawing Sheets

SHEET FEEDER AND IMAGE FORMING APPARATUS HAVING THE SAME

BACKGROUND OF THE INVENTION

1. Field of Invention

The invention relates to a sheet feeder that feeds cut sheets and an image forming apparatus including the sheet feeder, and more particularly, to a device that separates and feeds sheets, one by one, by abutting leading edges of the sheets in a sheet feed direction against an inclined separating surface formed by separating plates.

2. Description of Related Art

Conventional image forming apparatuses, such as laser-beam printers, color ink-jet printers, facsimile machines and copying machines, include a sheet feeder that feeds cut sheets, one by one, to an image forming unit provided therein. As disclosed in U.S. Pat. No. 6,158,733 and Japanese Laid-Open Patent Publication No. 2001-278507, the sheet feeder includes an inclined sheet holder, which holds a stack of sheets thereon, a separating plate, which is disposed below the sheet holder and has an inclined separating surface, and a sheet feed roller that is attached to an end of a rotatable arm having a predetermined length so as to face the sheet holder. The inclined separating surface extends such that the inclined separating surface and an upper surface of the sheet holder form an obtuse angle therebetween. Thus, the sheets stacked on the sheet holder are held by the inclined separating surface of the separating plate with the leading edges of the sheets contacting the inclined separating surface.

As the sheet feed roller rotates while pressing a topmost sheet in the stack on the sheet holder, the leading edge of the topmost sheet, which is being downwardly fed, abuts against the inclined separating surface. At that time, with a reaction force from the inclined separating surface, the topmost sheet is conveyed in a state where the lower part of the sheet is bent in a direction orthogonal to a direction that the rest of the sheets extend (the topmost sheet is convexedly warped such that the surface of the topmost sheet comes away from the stack of the sheets). Before long, the trailing edge of the sheet comes away from the inclined separating surface and thus only the topmost sheet is separated from the stack of the sheets. After that, the separated sheet is fed to the image forming unit by a conveying roller provided in a sheet feed path, to form an image thereon. Then, the sheet having the image is ejected from the image forming apparatus.

The above-described conventional inclined separating surface includes a flat surface along a sheet width direction. A sheet feed roller to be provided in the sheet feeder may not have a length across the entire width of the sheet. Recently, the length of the sheet feed roller is designed as short as possible in order to achieve miniaturization and low power consumption of the sheet feeder. Therefore, a small sheet feed roller is provided at the substantially middle in the sheet width direction to contact a portion of a middle area of the sheet with the sheet feed roller.

Further, most of sheet feeders feed cut sheets of different types and sizes by using the same mechanism. When large-sized sheets are fed, the sheet feed roller contacts only a part of the sheets in the sheet width direction to feed the sheets. When soft or week sheets are fed by the sheet feeder that includes the above-described small sheet feed roller that contacts only a part of the sheets, the sheets are conveyed one by one while being warped such that the leading edges of the middle areas of the sheets are abutting against a portion on an extension of the acting portion of the sheet feed roller, in the inclined separating surface. At that time, side areas of the sheets, which are a distance from the acting portion of the sheet feed roller in the sheet width direction, become free ends, which are free from the sheet feeding force by the rotation of the sheet feed roller. Therefore, during the sheet feeding operation by the sheet feed roller, both side areas of the sheets are kept substantially flat while the sheets are being conveyed.

When the above-described situation is viewed from a direction facing the sheets stacked on the sheet holder, the inclined separating surface includes a flat surface along the sheet width direction. With this structure, the lower edges (leading edges in a sheet feed direction) of the side areas of the sheets contact the inclined separating surface before the leading edges of the middle areas of the sheets contact the inclined separating surface. Because of this, the middle areas of the sheets will be further warped. Accordingly, the lower edges (leading edges in the sheet feed direction) of the middle areas of the sheets easily come off from the corresponding portion of the inclined separating surface.

On the other hand, however, the lower edges (leading edges in the sheet feed direction) of the sheets hardly contact a separating member, which is provided on the inclined separating surface, according to a width and/or a position where the separating member is provided. Thus, it becomes difficult to contact the leading edges of the sheets with the separating member, and the separating action by the separating member cannot be surely exerted on the sheets. This may cause a multi-feed problem (feeding two or more sheets at a time).

SUMMARY OF THE INVENTION

The invention thus provides a sheet feeder, which can separate and feed sheets, one by one, from a stack of sheets, while a drive system for feeding sheets is compacted, and an image forming apparatus including the above-described sheet feeder.

The sheet feeder of the invention feeds sheets. The sheet feeder includes a sheet holder that holds a plurality of sheets, a sheet feed roller that holds the sheets in cooperation with the sheet holder and feeds a topmost sheet from the sheets held by the sheet holder, and an inclined separating surface that holds leading edges of the sheets held by the sheet holder. The inclined separating surface includes a surface that is gradually lowered in a sheet feed direction toward at least one end of the inclined separating surface in the sheet width direction, from a first portion, as a top, which corresponds to a second portion, which is on or near an extension of a line of sheet feed action by the sheet feed roller which extends from a third portion where the sheet feed roller contacts.

Therefore, the leading edges of the middle areas of the sheets can contact the separating unit in a state where the sheets are held so as not to contact the leading edges of the side areas of the sheets with the inclined separating surface or in a state where the sheets are held with leading edges of the side areas of the sheets contacting the inclined separating surface but with little resistance to the leading edges of the side areas of the sheets by the inclined separating surface. Thus, the leading edges of the middle areas of the sheets can be sufficiently applied with the separating action, thereby preventing a sheet feed problem, such as a multi-feed problem.

BRIEF DESCRIPTION OF THE DRAWINGS

Various embodiments of the invention will be described in detail with reference to the following figures wherein.

DETAILED DESCRIPTION OF PREFERRED EMBODIMENTS

Embodiments of the invention will be described with reference to the accompanying drawings. A first embodiment of the invention will be described below.

Figure 1:
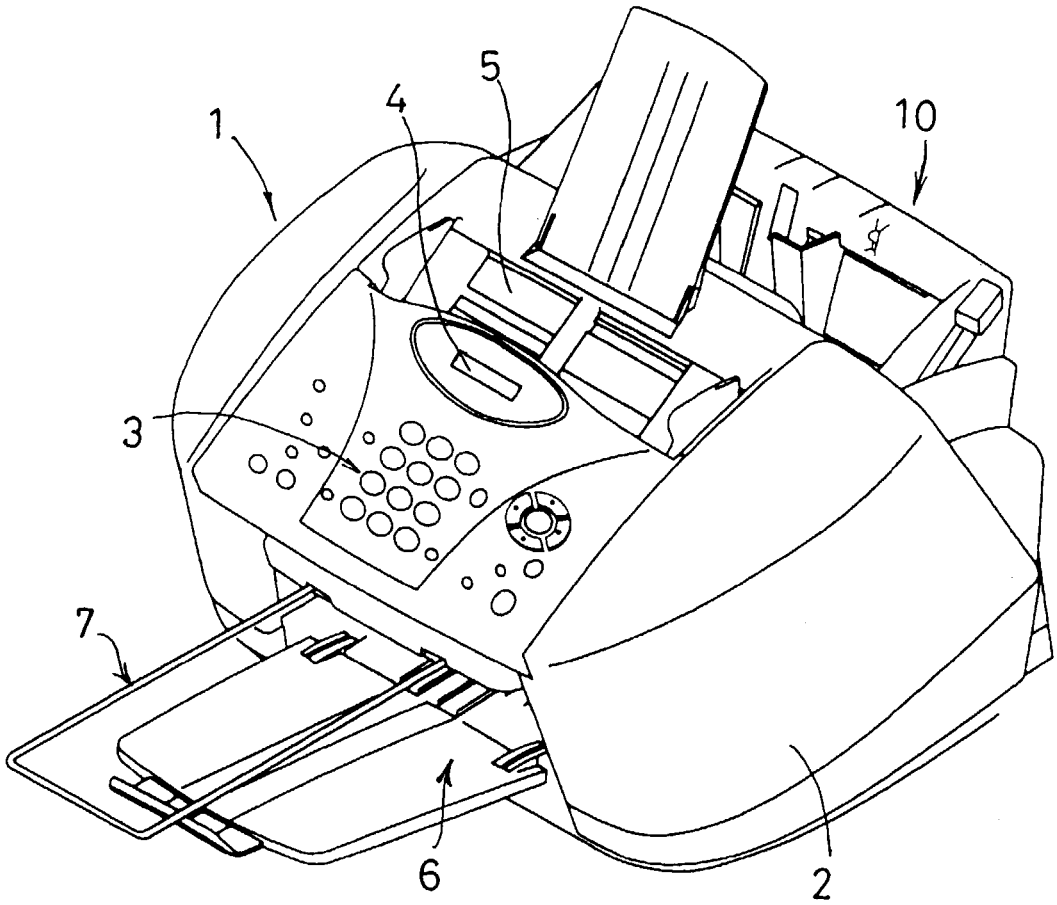
FIG. 1 is a perspective view of an image forming apparatus according to a first embodiment of the invention.
Figure 1:
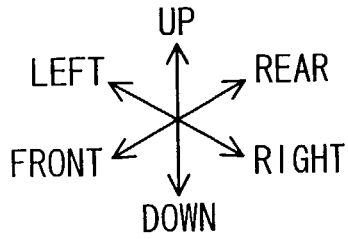

A multifunctional image forming apparatus 1 of FIG. 1 has a facsimile function, a printing function, a copying function, and a scanning function. As shown in FIG. 1, the image forming apparatus 1 includes a substantially box-shaped body 2. The body 2 has an operating panel 3 on its upper surface. The operating panel 3 is provided with various buttons and/or keys, such as a start button, numeric (0 to 9) buttons, and function keys. By pressing the buttons and keys, various operations are performed. A liquid crystal display (LCD) 4 is provided at an upper portion of the operating panel 3 to display setting conditions of the image forming apparatus 1 and various messages as needed. A side, on which the operating panel 3 is provided, is defined as a front of the image forming apparatus 1, and an opposite side is defined as a rear of the image forming apparatus. The right and left sides of the image forming apparatus 1 are defined as right and left, respectively, when viewed from the front of the image forming apparatus.

A document holding portion 5 is provided at the rear of the LCD 4. The document holding portion 5 holds original documents, which are to be copied and transmitted to another facsimile machine in the facsimile mode or which are to be copied in the copy mode. The original documents placed on the document holding portion 5 are conveyed to a scanning unit (not shown) provided in the body 2 and surfaces of the original documents are scanned by the scanning unit. Then, the scanned documents are ejected onto a document discharge portion 7 provided at the front of the body 2 (under the operating panel 3).

A sheet feeder 10, on which a stack of recording sheets P are loaded, is provided at the rear of the document holding portion 5. The sheets P placed on the sheet feeder 10 are conveyed, one by one, to a color ink-jet type image forming unit (not shown) provided in the body 2. At the image forming unit, predetermined images are printed onto the sheets P, and then, the sheets P are ejected onto a sheet discharge portion 6. The image forming unit is not limited to the ink-jet type, but can be other types, for example, a laser printing type using toner or a thermal transfer type using an ink ribbon.

Figure 2:
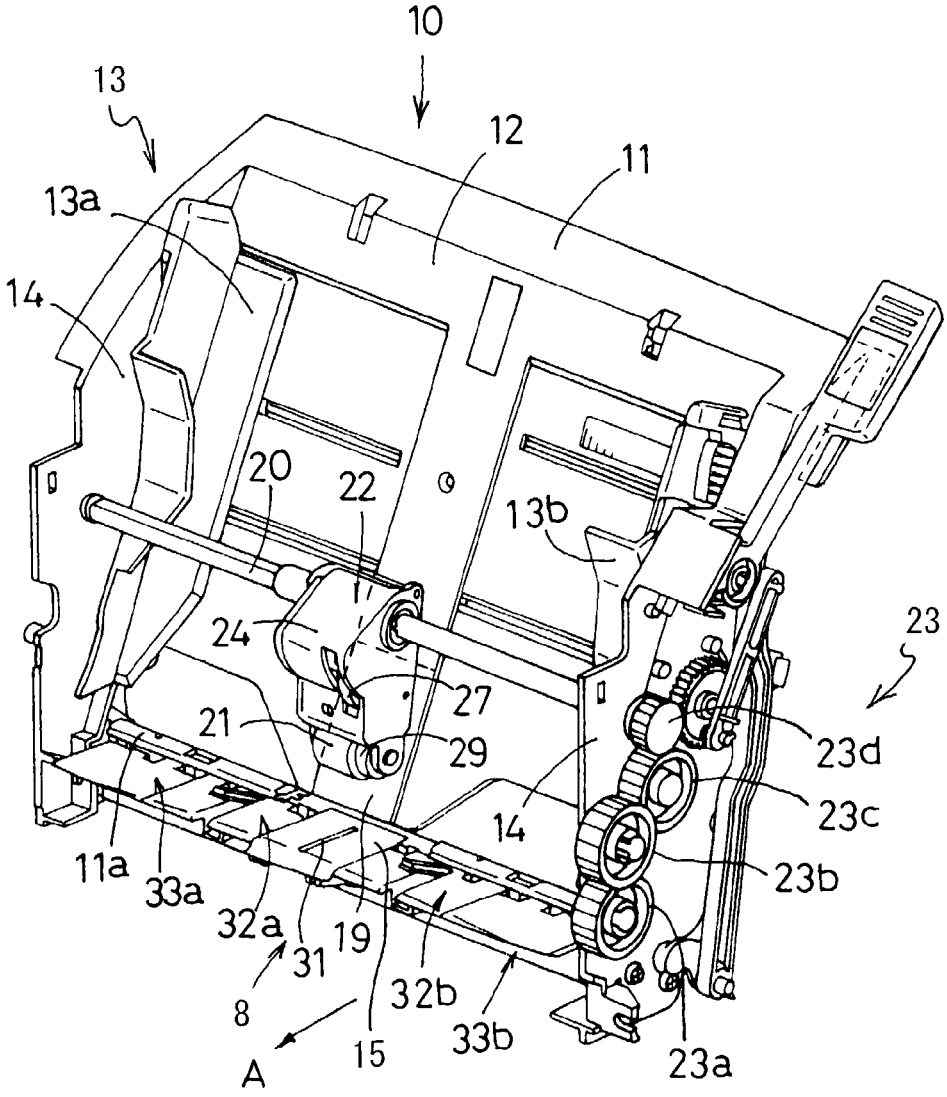
FIG. 2 is a perspective view of a sheet feeder according to the first embodiment of the invention.
Figure 3:
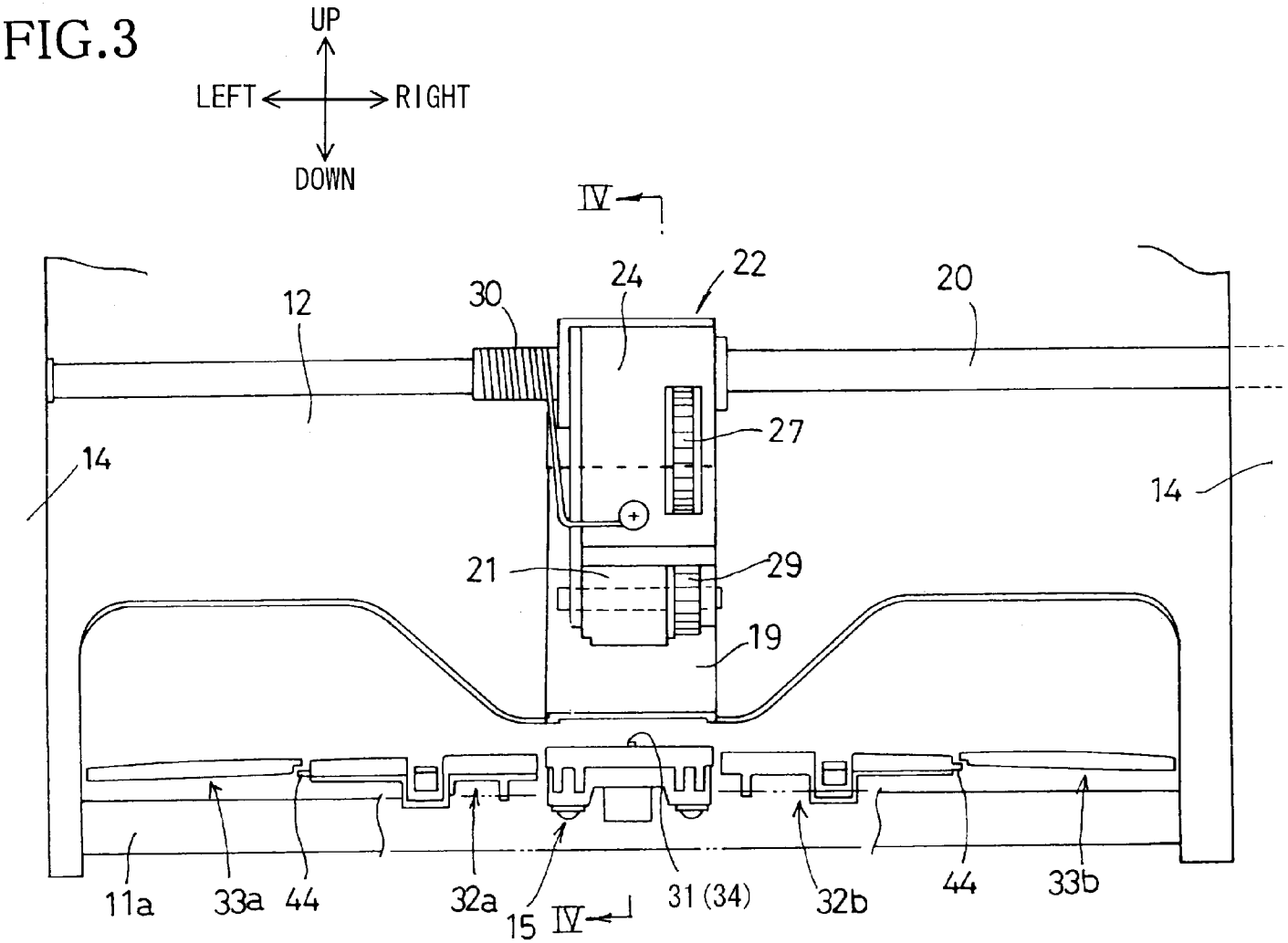
FIG. 3 is a front view showing essential parts of the sheet feeder.
Figure 4:
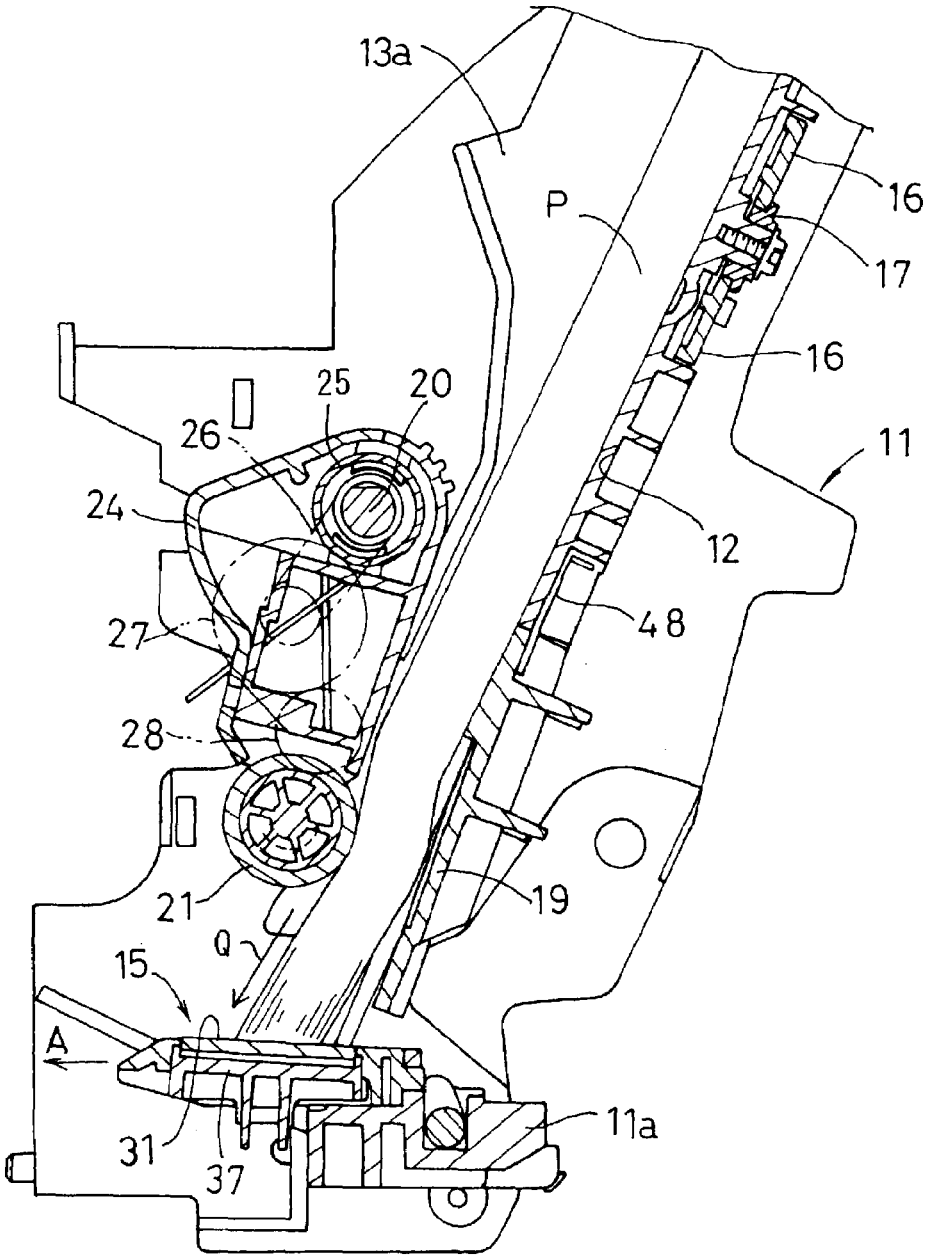
FIG. 4 is a sectional view taken along a line IV—IV of FIG. 3.

As shown in FIGS. 2 to 4, the sheet feeder 10 includes a frame 11. The frame 11 includes an inclined sheet holder 12, a pair of side walls 14 and a guide 13, i.e., a pair of guide members 13*a*, 13*b*. The sheet holder 12 is downwardly inclined in a direction toward the front of the image forming apparatus 1. The side walls 14 integrally stand from right and left edges of the sheet holder 12. The guide members 13*a*, 13*b* are provided to the sheet holder 12 and inside with respect to the side walls 14. The guide members 13*a*, 13*b* are slidable in right and left directions with respect to the sheet holder 12. The sheet holder 12 and the side walls 14 are made of synthetic resin and integral to form a monolithic structure. The sheet holder 12 can hold a stack of sheets P thereon. The frame 11 has a lower frame portion 11*a*. The lower frame portion 11*a* is provided with a plurality of separating plates 15, 32*a*, 32*b*, 33*a*, 33*b* to receive leading edges of the sheets P and to guide and send the sheets P, one by one, to the image forming unit. Upper surfaces of the separating plates 15, 32*a*, 32*b*, 33*a*, 33*b* form an inclined separating surface 8, which is an upwardly convex surface. The separating plates 15, 32*a*, 32*b*, 33*a*, 33*b* protrude from the lower frame portion 11*a* in a sheet advance direction indicated by an arrow A in FIGS. 2 and 4 to hold the leading edges of the sheets P stacked on the sheet holder 12 (FIGS. 2, 3 and 4). Explanations of the inclined separating surface 8 and the separating plates 15, 32*a*, 32*b*, 33*a*, 33*b* will be provided later.

The guide members 13*a*, 13*b* are coupled to racks 16, which are disposed on the back of the sheet holder 12 and extend in a horizontal direction. A pinion 17 is also provided on the back of the sheet holder 12 so as to engage the racks 16. In synchronization of the racks 16 and the pinion 17, the pair of the guide members 13*a*, 13*b* slide in a width direction of the sheet holder 12 (in the right and left directions) (FIGS. 2 and 3). Thus, the guide members 13*a*, 13*b* can get closer to and get away from each other to guide side edges of the sheets P in accordance with the width of the sheets P stacked between the guide members 13*a* and 13*b*. Consequently, the sheets P can be placed in the middle of the sheet holder 12 in the width direction of the sheets P.

A drive shaft 20 is rotatably supported between the side walls 14, at an appropriate distance upward from the upper surface of the separating plate 15. A sheet feed roller unit 22 is provided substantially at the middle of the drive shaft 20, that is, at the middle of the sheet P in the width direction (in the right and left directions). The sheet feed roller unit 22 includes a case 24 having a sheet feed roller 21. The drive shaft 20 is inserted into the case 24 of the sheet feed roller unit 22 so that only the case 24 can easily rotate. A gear train 23, including gears 23*a*, 23*b*, 23*c*, 23*d*, is provided to an outer surface of one of the side walls 14 in order to transmit power to the sheet feed roller 21 from a drive motor (not shown) provided in the body 2 (FIG. 2).

As shown in FIG. 4, the case 24 of the sheet feed roller unit 22 contains a drive gear 25 that integrally rotates with the drive shaft 20, a planet gear 27 that engages the drive gear 25, and an intermediate gear 28. A gear 29 is provided so as to engage the intermediate gear 28 and integrally rotate with the sheet feed roller 21. A part of the gear 29 is covered with a lower portion of the case 24. An arm 26 is rotatably fitted to the drive shaft 20. The planet gear 27 is rotatably supported by the arm 26. A torsion spring 30 (FIG. 3) is fitted into the drive shaft 20. The case 24 is urged by the torsion spring 30 so that the sheet feed roller 21 is pressed against a surface of a topmost sheet P in the stack.

As the gear 23*d*, which is fixed to an end of the drive shaft 20, rotates in a normal direction (in a counterclockwise direction in FIG. 2) at a sheet feeding operation, the drive gear 25 also rotates in the normal direction. At that time, a force for rotating in a reverse direction (in a clockwise direction in FIG. 2) is applied to the planet gear 27 engaging the drive gear 25, so that the arm 26 swings in the normal direction and thus the planet gear 27 engages the intermediate gear 28. Therefore, the intermediate gear 28 rotates in the normal (counterclockwise) direction and the gear 29 and the sheet feed roller 21 rotate in the reverse (clockwise) direction. Thus, the topmost sheet P, which is in contact with the sheet feed roller 21, is conveyed downward in FIG. 4. Also, when the drive shaft 20 rotates in a normal direction, the planet gear 27 also presses the case 24 through the intermediate gear 28 with a sheet feed force (rotation force) against the surface of the topmost sheet P.

When the gear 23*d* rotates in the reverse (clockwise) direction, the planet gear 27 is applied with a force for rotating in the normal direction from the drive gear 25 rotating in the reverse direction. Therefore, the arm 26 swings in the reverse direction, so that the planet gear 27 disengages from the intermediate gear 28 and thus the power to the sheet feed roller 21 is disconnected. Consequently, the sheet feed roller 21 stops rotating, thereby stopping the sheet feeding operation (the sheets P are not fed).

Figure 5:
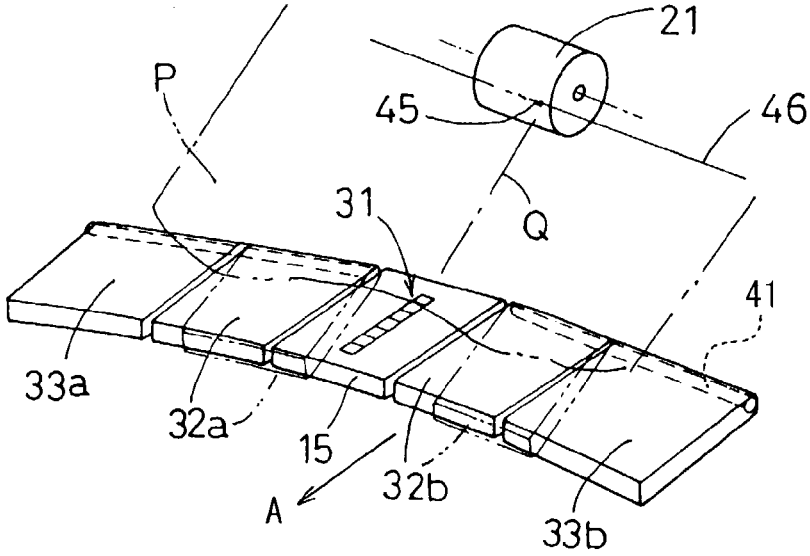
FIG. 5 is a perspective view of a split-type inclined separating surface, which includes a fixed separating plate and movable separating plates, according to the first embodiment.
Figure 7:
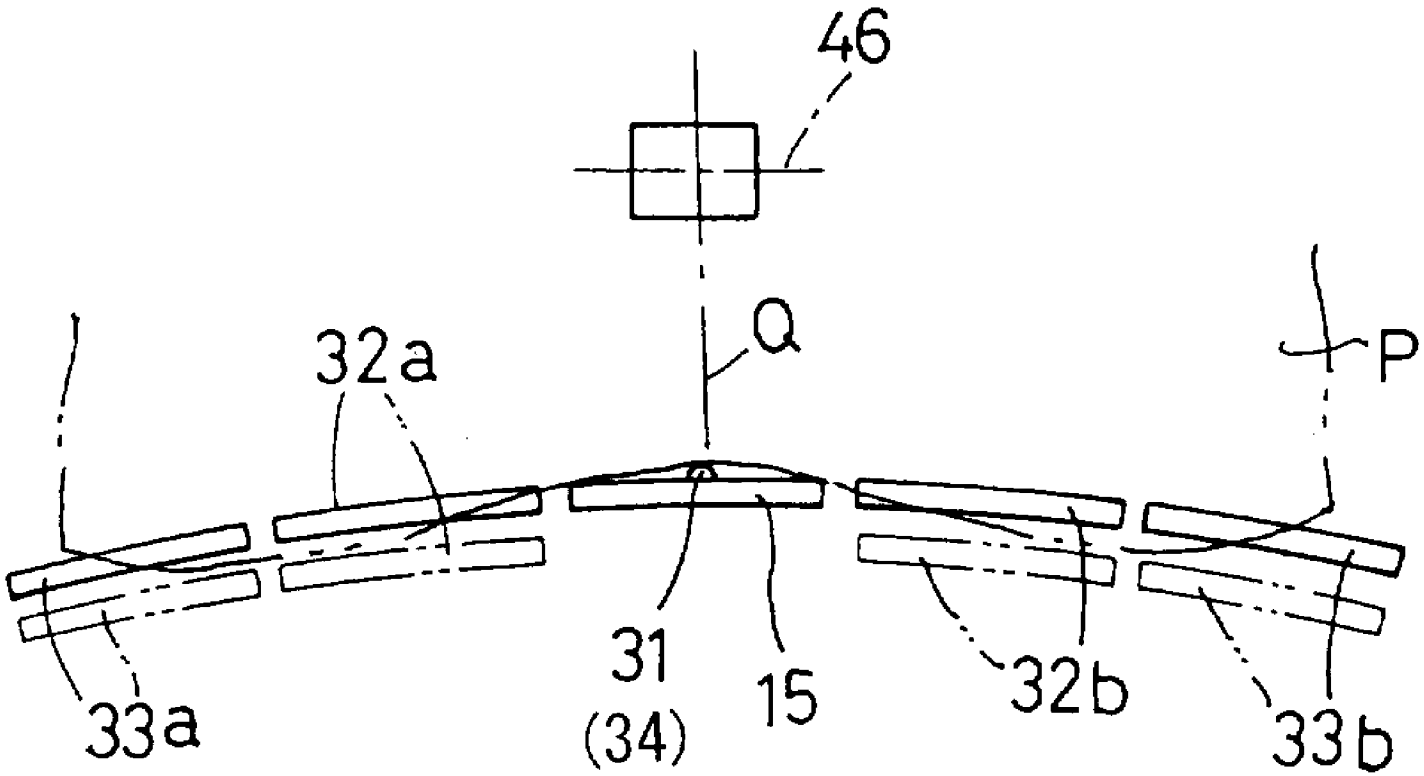
FIG. 7 is a front view of a split-type inclined separating surface according to a second embodiment.

Next, the structure of the inclined separating surface 8 of the first embodiment of the invention will be described in detail. The inclined separating surface 8 is provided with a sheet separating unit 31 having a high coefficient of friction. The sheet separating unit 31 contacts the leading (lower) edges of the middle areas of the sheets P in the sheet width direction to separate the sheets P, one by one, from the sheets P stacked on the sheet holder 12. The sheet separating unit 31, projecting from the inclined separating surface 8, is disposed on an extension of a line of sheet feeding action Q of the sheet feed roller 21 (FIGS. 5 and 7). The inclined separating surface 8 has a upwardly curved surface such that a portion near the sheet separating unit 31 is uplifted and the surface is gradually lowered near the ends of the inclined separating unit 31, in the sheet width direction.

FIGS. 2 to 6 show details of the shape and structure of the inclined separating surface 8 of the first embodiment. In the first embodiment, the inclined separating surface 8 is defined by upper surfaces of a fixed separating plate 15, first movable separating plates 32*a*, 32*b* and second movable separating plates 33*a*, 33*b*, which are made of synthetic resin. As shown in FIG. 3, the fixed separating plate 15 is disposed at a portion corresponding to the middle area of the sheet holder 12 in the width direction of the sheet holder 12 (at a portion on the extension of the line of sheet feeding action Q of the sheet feed roller 21). The first movable separating plates 32*a*, 32*b* are disposed on the left and right sides of the fixed separating plate 15, respectively. The second movable separating plate 33*a* is disposed on the left of the first movable separating plate 32*a*, and the second movable separating plate 33*b* is disposed on the right of the first separating plate 32*b*. Although the separating plates 15, 32*a*, 32*b*, 33*a*, 33*b* are separated from each other, the upper surfaces of the separating plates 15, 32*a*, 32*b*, 33*a*, 33*b* form the continuous inclined separating surface 8. That is, the middle of upper surface of the fixed separating plate 15 in the right and left direction is in the highest level and outer sides of the upper surfaces of the separating plates 33*a*, 33*b* are in the lowest level.

Figure 9A:
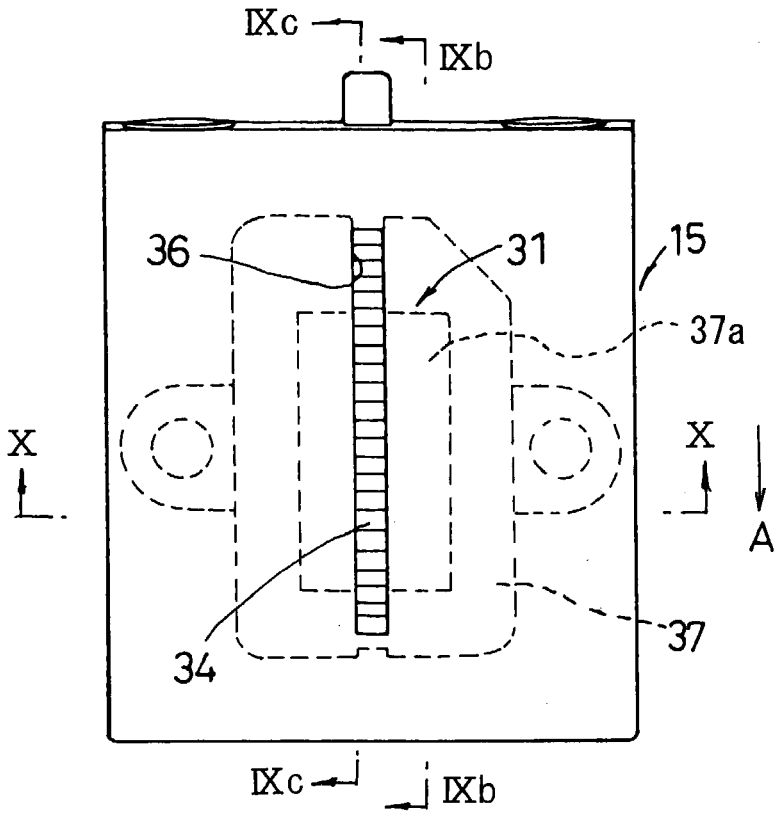
FIG. 9A is a plan view of the fixed separating plate including a sheet separating unit.

In the first embodiment, a distance between outer edges of the movable separating plates 33*a*, 33*b* is approximately 210 mm and a difference of elevation in the convexedly curved surface of the inclined separating surface 8 is approximately between 2 and 3 mm (a radius of curvature of the order of 1500 mm) (FIG. 3). It is designed such that the upper surfaces of the fixed separating plate 15 and the movable separating plates 32*a*, 32*b*, 33*a*, 33*b* are upwardly inclined approximately 3 degrees with respect to the horizontal plane so that their free ends (the direction indicated by the arrow A in FIGS. 2, 4 and 9A) are lifted with respect to the horizontal plane, when the movable separating plates 32*a*, 32*b*, 33*a*, 33*b* are free from a load (in a initial state). An inclined angle between the sheet holder 12 and each upper surface of the separating plates 15, 32*a*, 32*b*, 33*a*, 33*b* is an obtuse angle of approximately 112.5 degrees, when no load is applied to the movable separating plates 32*a*, 32*b*, 33*a*, 33*b*. The above-described set values for the difference of elevation and the inclined angle are values, in which the movable separating plates 32*a*, 32*b*, 33*a*, 33*b* are not rotated and which are set with reference to dimensions of letter-sized sheets and the rigidity of plain sheets to be commonly used.

The sheet separating unit 31 includes a separating strip 34, extending in the front to rear direction, so that the separating strip 34 is disposed at the upper surface of the fixed separating plate 15, at the substantially middle in the right and left direction. FIGS. 9 to 11B show the structure of the fixed separating plate 15 and the sheet separating unit 31 having the separating strip 34 in detail. The fixed separating plate 15 has a slit 36, which penetrates the fixed separating plate 15 and extends along a sheet advance direction (a direction A shown in FIGS. 2, 4 and 9A). A mounting block 37, made of synthetic resin, is detachably attached to the underside of fixed separating plate 15 by screws 38. The separating strip 34 is made of a material having a high coefficient of friction, such as polyester urethane resin. A bridge plate 39 includes a leaf spring made of phosphor bronze and has a plurality of cantilever supporting portions 39*a* and an outer frame portion 39*b*. The plurality of cantilever supporting portions 39*a* inwardly protrude from the outer frame portion 39*b*, like comb teeth, as shown in FIG. 10A. The separating strip 34 is resiliently supported by the cantilever supporting portions 39*a* of the bridge plate 39 such that the cantilever supporting portions 39*a* are inserted into the separating strip 34 (FIGS. 11A and 11B).

Figure 9B:
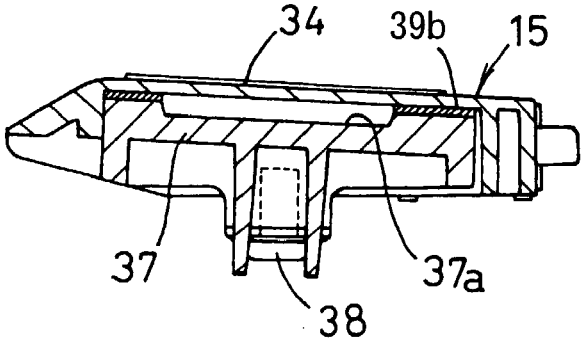
FIG. 9B is a sectional view taken along a line IXb—IXb of FIG. 9A.
Figure 9C:
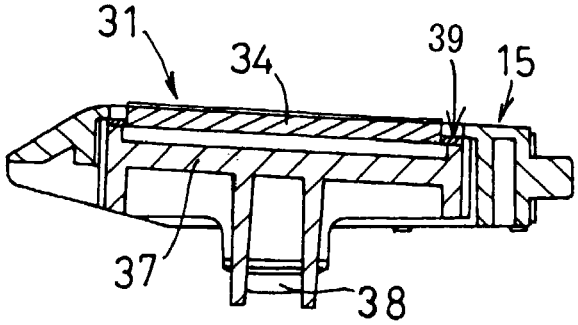
FIG. 9C is a sectional view taken along a line IXc—IXc of FIG. 9A.
Figure 10:
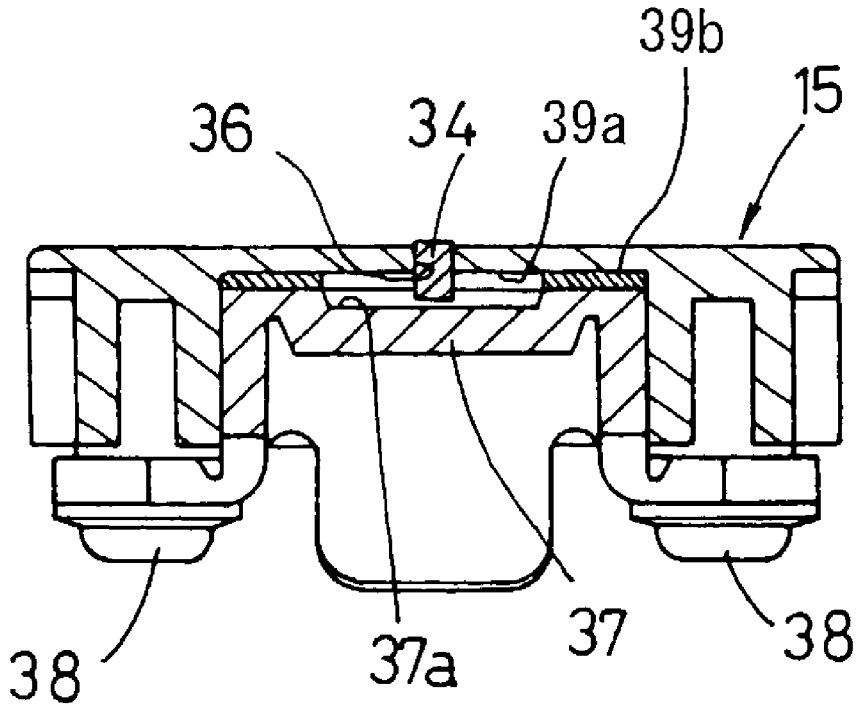
FIG. 10 is a sectional view taken along a line X—X of FIG. 9A.
Figure 11B:
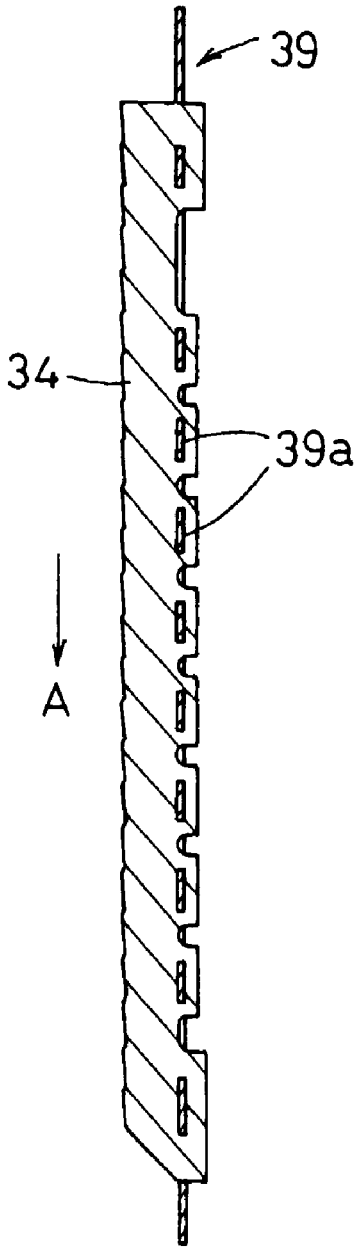
FIG. 11B is a sectional view taken along a line XIb—XIb of FIG. 11A.
Figure 11A:
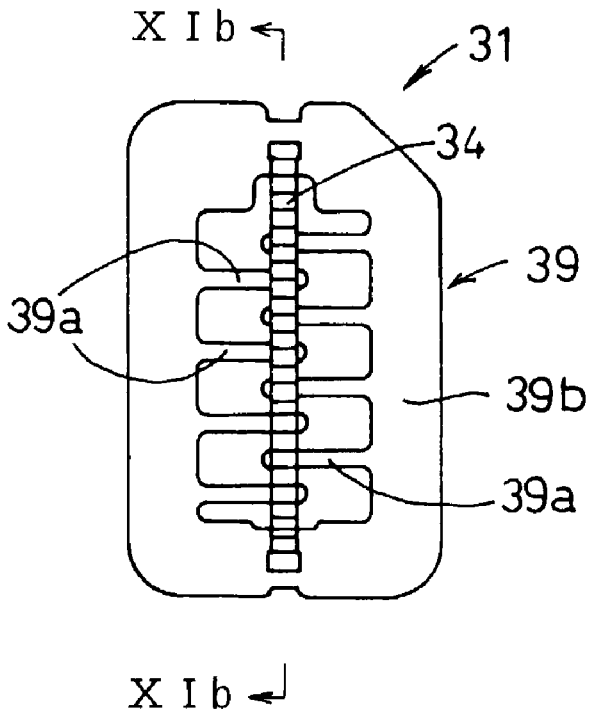
FIG. 11A is a plan view of the sheet separating unit.

Only the outer frame portion 39*b*, which has a substantially rectangular shape when viewed from above (FIG. 11A), is pinched between the mounting block 37 and the fixed separating plate 15, so that the separating strip 34 and the cantilever supporting portions 39*a* are held in midair in a recessed portion 37*a* of the mounting block 37 (FIGS. 9B, 9C and 10). Therefore, when a downward pressing force is applied to the separating strip 34 from above by the leading edges of the sheets P due to the sheet feeding operation by the sheet feed roller 21, the separating strip 34 is pressed downward and thus the plurality of the cantilever supporting portions 39*a* warp downwardly. Consequently, the upper surface of the separating strip 34 becomes the same level as the upper surface of the fixed separating plate 15. That is, the separating strip 34 can surely contact and catch the leading edges of the sheets P, thereby reliably performing the separating action of the sheets P.

As shown in FIG. 11B, the upper surface of the separating strip 34 is saw-toothed (uneven) so that a high frictional resistance can be applied to the sheets P when the leading edges of the sheets P contact and slide over the separating strip 34. The shape of the upper surface of the separating strip 34 further increases the coefficient of friction, in addition to the frictional coefficient of the material forming the separating strip 34.

Figure 6:
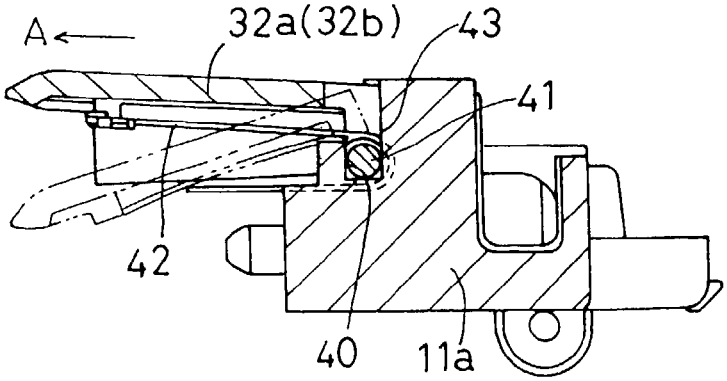
FIG. 6 is an enlarged sectional view of one of the movable separating plates.

As shown in FIG. 6, a rotation support shaft 41 integrally protrudes from a base to an end of each of the movable separating plates 32*a*, 32*b*, 33*a*, 33*b*. The lower frame portion 11*a* of the frame 11 has recessed portions 40, in which the rotation support shafts 41 of the movable separating plates 32*a*, 32*b*, 33*a*, 33*b* are rotatably fitted. Torsion springs 42 are fitted to the rotation support shafts 41 while both of the ends are caught at predetermined positions, in order to upwardly urge the separating plates 32*a*, 32*b*, 33*a*, 33*b*, independently. The movable separating plates 32*a*, 32*b*, 33*a*, 33*b* are designed such that back surfaces 43 of the base end portions of the movable separating plates 32*a*, 32*b*, 33*a*, 33*b* contact inner walls of the recessed portions 40 to restrict excessive upward rotation of the movable separating plates 32*a*, 32*b*, 33*a*, 33*b*. With this restriction, the upper surfaces of the movable separating plates 32*a*, 32*b*, 33*a*, 33*b* are not lifted to the level higher than the upper surface of the fixed separating plate 15 and the second movable separating plates 33*a*, 33*b* are not lifted to the level higher than the upper surfaces of the first separating plates 32*a*, 32*b*. Alternatively, different ways can be adopted to restrict the excessive upward rotation of the movable separating plates 32*a*, 32*b*, 33*a*, 33*b*.

As shown in FIG. 3, an engaging projection 44 laterally projects from the first movable separating plates 32*a*, 32*b* so as to engage the undersides of the second movable separating plates 33*a*, 33*b*, respectively, from below. With this structure, even when a downward load acts on the second movable separating plates 33*a*, 33*b* only, the second movable separating plates 33*a*, 33*b* rotate downward and thus engage the respective engaging projections 44 of the first movable separating plates 32*a*, 32*b* to press the engaging projections 44 downwardly. Thus, the first movable separating plates 32*a*, 32*b* also rotate downward with the second movable separating plates 33*a*, 33*b*.

Referring to FIGS. 4 and 5, the sheet separating action performed by the sheet feeder 10 in the above-described structure when the sheet feed roller 21 rotates to feed sheets P will be described below. A plurality of sheets P are loaded onto the sheet holder 12 of the sheet feeder 10 in advance. In this state, the leading edges of the sheets P stacked on the sheet holder 12 are in contact with the upper surface of the fixed separating plate 15 and/or the separating strip 34, but not in contact with the first movable separating plates 32*a*, 32*b* nor the second movable separating plates 33*a*, 33*b*.

When a print command is executed in response to a signal transmitted from an external control device, such as a personal computer and a facsimile machine, the drive motor (not shown) drives to rotate the sheet feed roller 21. Therefore, the drive shaft 20 rotates in the reverse direction via the gear train 23 including the gears 23*a* to 23*d*, and then the sheet feed roller 21 rotates in the clockwise direction in FIG. 5. Accordingly, only a topmost sheet P pressed by the sheet feed roller 21 is conveyed in the direction indicated by the arrow A in FIG. 5. When a sheet feeding operation is performed in a state where the leading edges of the middle areas of the sheets P abut against the sheet separating unit 31 (the separating strip 34), which is disposed on the extension of the line of the sheet feeding action Q of the sheet feed roller 21, a topmost sheet P, which is subjected to the sheet feeding action, is fed in the direction indicated by the arrow A while deforming in a middle area of the topmost sheet P, between the sheet feed roller 21 and the sheet separating unit 31.

Sheets P having different rigidity will be placed on the sheet holder 12. When weak or soft sheets P (e.g. sheets are thin in thickness) are fed, a topmost sheet P, which is subjected to the sheet feeding action, is fed in the direction indicated by the arrow A while deforming such that a middle area of the topmost sheet P is uplifted in a direction to come away from the stack of the sheets P, between the sheet feed roller 21 and the sheet separating unit 31. On the other hand, when the strong or rigid sheets P, such as cardboard, post cards, envelops, and overhead transparency films, are fed from the sheet holder 12, a topmost sheet P, which is subjected to the sheet feeding action, deforms such that the middle area of the sheet P is uplifted in a direction toward the stack of the sheets P, between the sheet feed roller 21 and the sheet separating unit 31.

However, regardless of the rigidity of the sheets P, the sheet P is conveyed while its side areas, which are other than the middle area of the sheet P and are not subjected to the sheet feeding action, are flat. When the above-described situation happens, a distance (in straight line) between a point on a contact line (nip line) 45 of the sheet feed roller 21 and the sheet P subjected to the sheet feeding action and a point of the leading edge of the middle area of the topmost sheet P becomes shorter than a distance (in straight line) between a point on an extension 46 of the contact line 45 and a point on the side area of the leading edge of the topmost sheet P.

In order to cope with the above-described situation, in the sheet feeder 10 of the first embodiment, the sheet separating unit 31 having a high coefficient of friction protrudes from the inclined separating surface 8, in the extension of the line of the sheet feeding action Q of the sheet feed roller 21, on order to abut against the leading edges of the middle areas of the sheets P to separate the sheets P one by one from the stack. In addition, because the inclined separating surface 8 has a curved surface such that the portion near the sheet separating unit 31 is uplifted and the surface is gradually lowered near the ends in the sheet width direction, the leading edges of the middle areas of the sheets P can be sufficiently subjected to the sheet separating action by contacting the sheet separating unit 31 while the leading edges of the side areas of the sheets P do not interfere with the inclined separating surface 8 or contact the inclined separating surface 8 but with little resistance to the leading edges of the side areas of the sheets P. Accordingly, the sheet feeding problem, such as the multi-feed problem, can be prevented.

When sheets P to be fed have the letter size and the rigidity of plain sheets, the sheets P are normally conveyed as described above without interfering with the movable separating plates 32*a*, 32*b*, 33*a*, 33*b*. However, when sheets P to be fed have a size (width) and rigidity, which are extremely different from the reference size and rigidity, leading edges of side areas of the sheets P may contact the movable separating plates 32*a*, 32*b*, 33*a*, 33*b* before the leading edges of the middle areas of the sheets P contact the fixed separating plate 15 and/or the sheet separating unit 31.

Even when the above-described case happens, in the first embodiment, the position of the fixed separating plate 15, which corresponds to the middle areas of the sheets P in the sheet width direction, is not changed, and the first separating plates 32*a*, 32*b* and/or the second separating plates 33*a*, 33*b* rotate against the urging forces from the torsion spring 42 so that the free ends of the first separating plates 32*a*, 32*b* and/or the second separating plates 33*a*, 33*b* rotate downward. By doing so, the upper surfaces of the separating plates 32*a*, 32*b*, 33*a*, 33*b* (the inclined separating surface 8) descend in a direction to get away from the leading edges of the sheets P to make a clearance between the leading edges of the sheets P and the separating plates 32*a*, 32*b*, 33*a*, 33*b*. Therefore, the leading edge of the topmost sheet P can be prevented from being interfered with the first movable separating plates 32*a*, 32*b* and/or the second movable separating plates 33*a*, 33*b* during the sheet feeding operation. Thus, the leading edge of the topmost sheet P is not pressed or supported by the first movable separating plates 32*a*, 32*b* and/or the second movable separating plates 33*a*, 33*b*. Consequently, the sheet separating action by the sheet separating unit 31 can be surely applied to the leading edges of the middle areas of the sheets P. In addition, the occurrence of a paper jam due to, such as the multi-feed problem (feeding two or more sheets at a time), can be restricted regardless of the size and rigidity of the sheets P.

FIG. 7 shows a structure of an inclined separating surface 8 according to a second embodiment of the invention. In the second embodiment, an urging member (not shown), such as a coil spring, is provided at the underside of each of the movable separating plates 32*a*, 32*b*, 33*a*, 33*b* to urge the movable separating plates 32*a*, 32*b*, 33*a*, 33*b* upward. Thus, the movable separating plates 32*a*, 32*b*, 33*a*, 33*b* can move up and down while their upper surfaces are maintained parallel to themselves. A sheet feeder of the second embodiment is the same in structure as the sheet feeder 10 of the first embodiment, other than the descending direction of the inclined separating surface 8. In the second embodiment, also, the inclined separating surface 8 includes, in the initial state, an upwardly curved surface which has an appropriate curvature for the sheet feeding operation. When sheets P, having the letter-size and the rigidity of plain sheets, are used, the sheets P can be fed without interfering with the upper surfaces of the movable separating plates 32*a*, 32*b*, 33*a*, 33*b* (the inclined separating surface 8). In addition, the movable separating plates 32*a*, 32*b*, 33*a*, 33*b* form an upwardly convex surface appropriate for the sheet feeding operation by descending by an appropriate amount, in accordance with the rigidity and size of the sheets P stacked on the sheet holder 12, by which the leading edges of the sheets P stacked on the sheet holder 12 press the movable separating plates 32*a*, 32*b*, 33*a*, 33*b* when the sheet feed roller 21 drives to feed the sheets P. Accordingly, the second embodiment can provide the same effects as that obtained by the first embodiment.

In the above-described embodiments, the inclined separating surface 8 includes the movable separating plates 32*a*, 32*b*, 33*a*, 33*b* with consideration given to the sheet feeder 10 that feeds sheets P having different sizes and rigidity. However, if only limited types (size and rigidity) of sheets are used in the sheet feeder 10, the inclined separating surface 8 can be structured as described below.

Figure 8A:
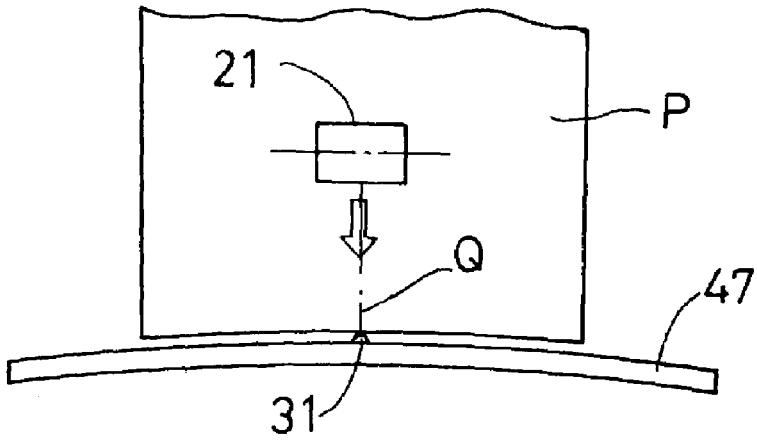
FIG. 8A is a front view showing a non-spilt type inclined separating surface, which includes a long single separating plate, according to a third embodiment of the invention.
Figure 8B:
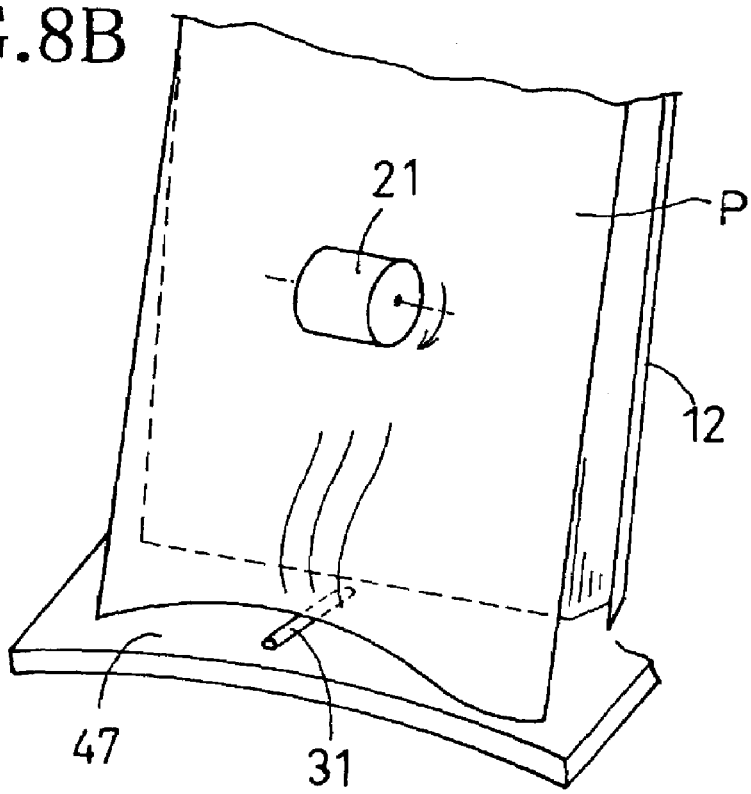
FIG. 8B is a perspective view of the separating plate of FIG. 8A.

FIGS. 8A and 8B show a third embodiment of the invention. In this embodiment, a single separating plate 47, extending in the width direction of the sheet holder 12, is provided. The separating plate 47 includes a curved or linearly inclined separating surface 8 such that a portion near the separating unit 31 is uplifted and the surface is gradually lowered near the ends in the sheet width direction. In addition, the sheet separating unit 31 having a high coefficient of friction is provided so as to protrude from the inclined separating surface 8, on the extension of the line of the sheet feeding action Q of the sheet feed roller 21, in order to contact the leading edges of the middle areas of the sheets P in the sheet width direction to separate the sheets P one by one. With this structure, also, the leading edges of the middle areas of the sheets P can be sufficiently applied with the sheet separating action by abutting against the sheet separating unit 31 while the leading edges of side areas of the sheets P do not interfere with the inclined separating surface 8. As a result, the sheet feed problem, such as the multi-feed problem, can be prevented.

As described above, in the sheet feeder 10 of each of the embodiments, the sheet separating unit 31, which contacts the leading edges of the middle areas of the sheets P to separate the sheets P, protrudes from the inclined separating surface 8, at a portion on or near the extension of the line of the sheet feeding action Q of the sheet feed roller 21. Further, the inclined separating surface 8 includes a surface such that the portion near the sheet separating unit 31 is uplifted and the surface is gradually lowered in the sheet feed direction near the ends in the sheet width direction, when viewed from a direction perpendicular to the sheet feed direction.

Accordingly, the leading edges of the middle areas of the sheets P can be sufficiently applied with the separating action by abutting the sheet separating unit 31 in a state where the leading edges of the side areas of the sheets P do not interfere with the inclined separating surface 8 or in a state where the leading edges of the side areas of the sheets P contacts the inclined separating surface 8 but with little resistance to the leading edges of the side areas of the sheets P by the inclined separating surface. Consequently, the sheet feed problem, such as the multi-feed problem, can be prevented.

When viewed from a direction perpendicular to the sheet feed direction (the force acting direction of the sheet feed roller 21), the inclined separating surface 8 of each of the embodiments includes the surface such that the portion near the sheet separating unit 31 is uplifted and the surface is gradually lowered near the ends in the sheet width direction. With this structure, the inclined separating surface 8 extends substantially along the curved line formed by the leading edges of the sheets P. Therefore, the sheet feed problem, such as a sheet deviation, can be prevented.

While the invention has been described in detail with reference to the specific embodiments thereof, it would be apparent to those skilled in the art that various changes, arrangements and modifications may be applied therein without departing from the spirit and scope of the invention. For example, the sheet separating unit 31 (the separating strip 34) is not limited to that shown in the above-described embodiments. A sheet separating unit having a different structure can be used as long as the sheet separating unit causes friction. Further, in the above-described embodiments, the invention has been applied to the sheet feeder 10 that includes the inclined sheet holder 12 with the fixed separating plate 15, the first movable separating plates 32*a*, 32*b*, and the second movable separating plates 33*a*, 33*b* inclinatorily provided at the lower portion of the sheet holder 12 or the sheet feeder 10 that includes the inclined sheet holder 12 with the single separating plate 47 inclinatorily provided at the lower portion of the sheet holder 12. However, the invention can be applied to a sheet feeder wherein the sheet holder 12 is provided substantially in the horizontal position and the long single separating plate 47 or the fixed separating plate 15 and the movable separating plates 32*a*, 32*b*, 33*a*, 33*b* are disposed such that the sheet advance direction of the sheet P stacked on the sheet holder 12 extends toward the upwardly slanting direction.

Further, in each of the embodiments described above, the inclined separating surface 8 includes the surface that is gently curved in the initial state. However, the inclined separating surface 8 may include a surface that is formed by two inclined straight lines, for example, an inverted V-shaped surface, in the initial state.

Furthermore, the inclined separating surface 8 is not limited to the inclined separating surface 8 that forms the upwardly curved surface in a state where the movable separating plates 32*a*, 32*b*, 33*a*, 33*b* descend. The inclined separating surface 8 in a different structure can be adopted as long as a convex surface, which is different from the shape of the surface in the initial state, is formed by the linearly extending upper surfaces of the movable separating plates 32*a*, 32*b*, 33*a*, 33*b*, so that the surface is gradually lowered near the ends in the sheet width direction, from the separating strip 34 of the fixed separating plate 15 as the top.

The difference of elevation in the inclined separating surface 8 can be set to various values in accordance with the rigidity and width of the sheets P to be mainly used. However, with consideration given to feeding of letter-sized plain sheets (approximately 210 mm in sheet width), the difference of elevation in the inclined separating surface 8 is set to between 1 mm and 4 mm, preferably between 2 mm and 3 mm. Alternatively, it is preferable that the radius of curvature of the inclined separating surface 8 is between 1000 mm and 2000 mm when the inclined separating surface 8 includes a curved surface. If the difference of elevation or the radius of curvature is too small, the sheet separation may not be excellently performed by the sheet feed roller 21 during the sheet feeding operation. On the other hand, if the difference of elevation or the radius of curvature is too large, the sheets P may deviate or may be partially bent during the sheet feeding operation.

In the above-described embodiments, the description has been made by applying the invention to the multifunctional image forming apparatus 1. However, if an image forming apparatus includes the sheet feeder 10 of either of the above-described embodiments, the invention can be applied thereto. For example, the invention can be applied to a printer that does not have a facsimile function if the printer includes the sheet feeder 10 of either of the embodiments. According to the image forming apparatus including the sheet feeder 10 of either of the embodiments, the multi-feed problem can be surely prevented. Therefore, predetermined images can be surely formed on sheets P, which are supplied one by one, by the image forming unit.

In the above-described embodiments, the sheets P are guided by the pair of the guide members 13*a*, 13*b* to contact the middle points of the leading edges of the sheets P with the sheet separating unit 31 (the separating strip 34), regardless of the size (width) of the sheets P. However, it is unnecessary to place the sheets P at the middle of the sheet holder 12. If the leading edges of the sheets P near the middle points of the sheets P contact the sheet separating unit 31 (the separating strip 34) (the sheets P are deviated to some extent in the right and left direction), the substantially same effects are promised by the invention. There is no problem even when the sheet separating unit 31 (the separating strip 34) is shifted to some extent from the extension of the line of the sheet feeding action Q as long as the sheet separating unit 31 (the separating strip 34) is provided near the extension.

What is claimed is:

1. A sheet feeder that feeds sheets, comprising:

a sheet holder that holds a plurality of sheets;

a sheet feed roller that holds the sheets in cooperation with the sheet holder and feeds a topmost sheet from the sheets stacked in the sheet holder;

an inclined separating surface that holds leading edges of the sheets held by the sheet holder, the inclined separating surface including a surface that is gradually lowered in a direction away from a leading edge of the plurality of sheets stacked in the holder toward at least one end of the inclined separating surface in the sheet width direction, from a first portion, as a top, which corresponds to a second portion, which is on or near an extension of a line of sheet feed action by the sheet feed roller which extends from a third portion where the sheet feed roller contacts.

2. The sheet feeder according to claim 1, wherein the inclined separating surface includes a separating unit at a fourth portion corresponding to the second portion on or near the extension of the line of sheet feeding action by the sheet feed roller which extends from the third portion of the sheet where the sheet feed roller contacts, and the separating unit has a first frictional coefficient higher than a second frictional coefficient of a sheet contacting surface of the inclined separating surface and separates the sheets by contacting the leading edges of the sheets.

3. The sheet feeder according to claim 2, wherein the inclined separating surface includes an upwardly curved surface that is gradually lowered in the direction away from a leading edge of the plurality of sheets stacked in the holder toward at least one end of the inclined separating surface in the sheet width direction, from the first portion, as a top, where the separating unit is provided, when viewed from a direction perpendicular to the sheet feed direction.

4. The sheet feeder according to claim 2, wherein the sheet feed roller is disposed substantially at a middle in the sheet width direction, and the separating unit is disposed at a portion, to which substantially middle portions of the leading edges of the sheets contact, on the inclined separating surface.

5. The sheet feeder according to claim 2, wherein the separating unit protrudes and retracts with respect to the inclined separating surface.

6. The sheet feeder according to claim 2, wherein a difference of elevation, in the sheet feed direction, between the portion of the separating unit and the side ends of the inclined separating surface in the sheet width direction, is between 1 mm and 4 mm.

7. The sheet feeder according to claim 6, wherein a difference of elevation, in the inclined separating surface, between the portion of the separating unit and the portions corresponding to side edges of the sheets of a letter size in its width direction, is between 2 mm and 3 mm.

8. The sheet feeder according to claim 1, wherein the inclined separating surface is formed so as to extend along a convex surface having a radius of curvature of between 1000 mm and 2000 mm in the sheet width direction.

9. The sheet feeder according to claim 1, wherein the sheet holder is inclined so that the leading edges of the sheets are held by the sheet holder at the lower end portion of the sheet holder, and the inclined separating surface is provided at the lower end portion of the sheet holder.

10. The sheet feeder according to claim 9, wherein the inclined separating surface is inclined such that a front end of the inclined separating surface in a sheet advance direction is lifted in the sheet feed direction, with respect to a horizontal plane.

11. The sheet feeder according to claim 10, wherein the inclined angle of the inclined separating surface, with respect to the horizontal plate, in the sheet feed direction, is approximately 3 degrees.

12. The sheet feeder according to claim 2, wherein the inclined separating surface includes a fixed member, which is fixedly provided near the separating unit, and a movable member, which is provided adjacent to the fixed member and can descend.

13. An image forming apparatus, comprising:

a sheet holder that holds a plurality of sheets;

a sheet feed roller holds the sheets in cooperation with the sheet holder and feeds a topmost sheet from the sheets;

an inclined separating surface that holds leading edges of the sheets held by the sheet holder, the inclined separating surface including a surface that is gradually lowered in a direction away from a leading edge of the plurality of sheets stacked in the holder toward at least one end of the inclined separating surface in the sheet width direction, from a first portion, as a top, which corresponds to a second portion, which is on or near an extension of a line of sheet feed action by the sheet feed roller which extends from a third portion where the sheet feed roller contacts; and an image forming unit that is disposed downstream in a sheet advance direction and forms images on the fed sheets.

14. A method of feeding sheets with a sheet holder that holds a plurality of sheets, a sheet feed roller that holds the sheets in cooperation with the sheet holder and an inclined separating surface that holds the leading edges of the sheets held by the sheet holder, comprising:

feeding a topmost sheet from the sheets stacked in the sheet holder; and lowering a surface of the inclined separating surface in a direction away from a leading edge of the plurality of sheets stacked in the holder toward at least one end of the inclined separating surface in the sheet width direction, from a first portion, as a top, which corresponds to a second portion, which is on or near an extension of a line of sheet feed action by the sheet feed roller which extends from the third portion where the sheet feed roller contacts when the topmost sheet is fed.

15. The sheet feeder according to claim 1, wherein the surface that is gradually lowered is substantially continuous.

16. The image forming apparatus according to claim 13, wherein the surface that is gradually lowered is substantially continuous.

17. The method according to claim 14, wherein the surface that is gradually lowered is substantially continuous.

* * * * *